United States Patent [19]

Jones et al.

[11] 4,327,867

[45] May 4, 1982

[54] SINK RINSING DEVICE

[75] Inventors: William E. Jones, 6643 Emmet Ter., Hollywood, Calif. 90068; Lynn R. Bowers, Portland, Oreg.

[73] Assignee: William E. Jones, Hollywood, Calif.

[21] Appl. No.: 38,783

[22] Filed: May 14, 1979

[51] Int. Cl.[3] ..... B05B 3/02

[52] U.S. Cl. ..... 239/214.23; 239/222.11; 239/223; 239/484; 239/511; 239/512; 239/519; 239/587

[58] Field of Search ..... 239/26, 27, 214, 214.23, 239/222.11, 223, 224, 482–485, 505, 507, 510–512, 519, 523, 587

[56] References Cited

U.S. PATENT DOCUMENTS 2,747,930 5/1956 Hyde ..... 239/27
2,785,013 3/1957 Stearns ..... 239/224
3,101,174 8/1963 Loveland ..... 239/27
3,856,203 12/1974 Clark ..... 239/27

*Primary Examiner*—Richard A. Schacher
*Attorney, Agent, or Firm*—Poms, Smith, Lande & Rose

[57] ABSTRACT

A sink rinsing device including an accelerating nozzle attached by a flexible stem to a fitting which fits onto a sink faucet above the aerator thereof. When not in use, the stem and nozzle lie flat against the underside of the faucet, out of the path of the water emerging from the faucet. When it is desired to rinse the sink, the stem is bent to bring the nozzle underneath the aerator of the faucet. The nozzle is removably fastenable to the fitting to secure the device in this position. Water emerging from the aerator of the faucet can now enter the inlet side of the nozzle, which directs a forceful stream of water against the sides of the sink. The fitting allows the nozzle to be rotated 360 degrees.

14 Claims, 5 Drawing Figures

Fig. 1
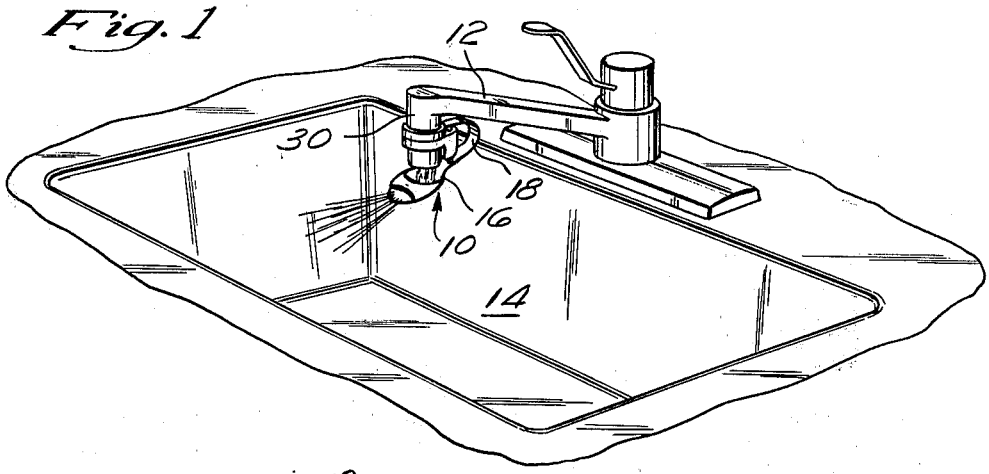
Fig. 2
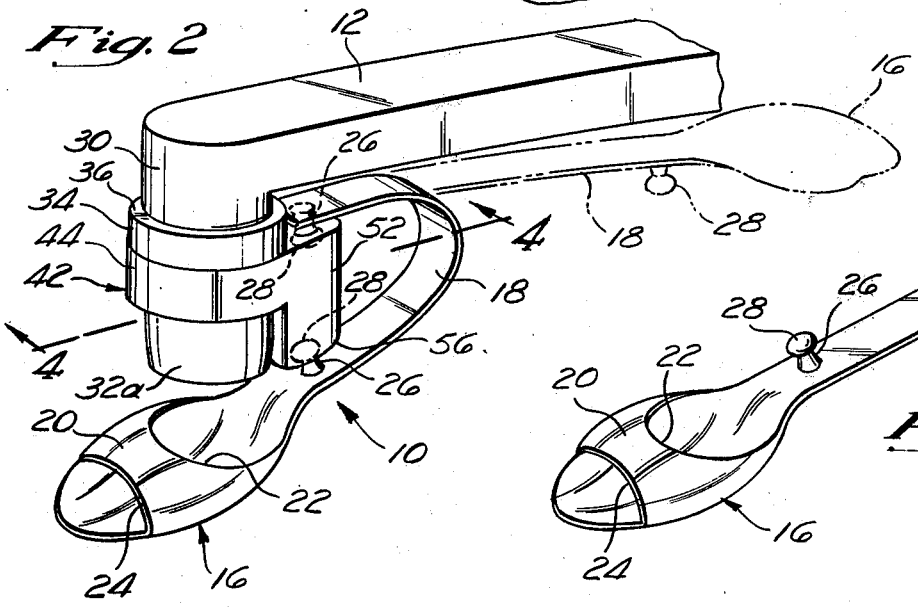
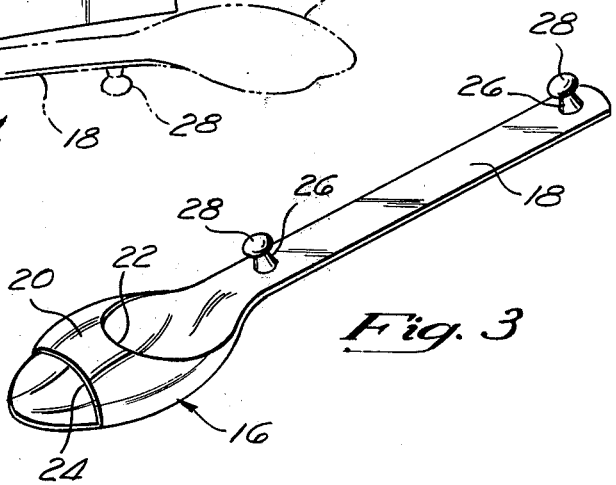
Fig. 3
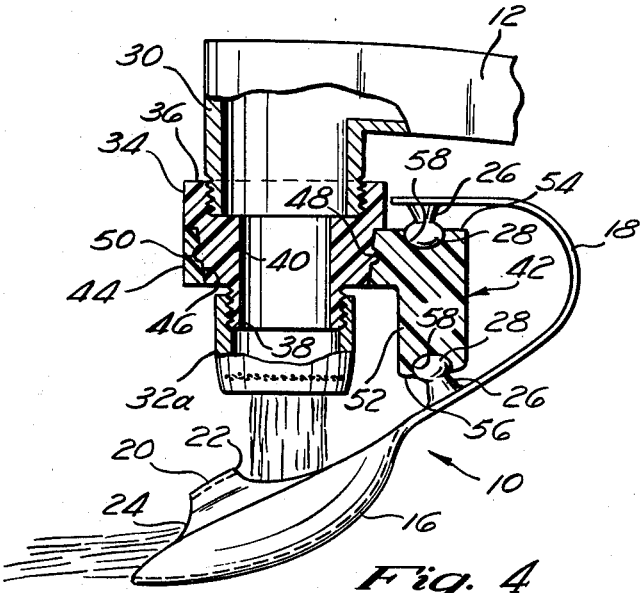
Fig. 4
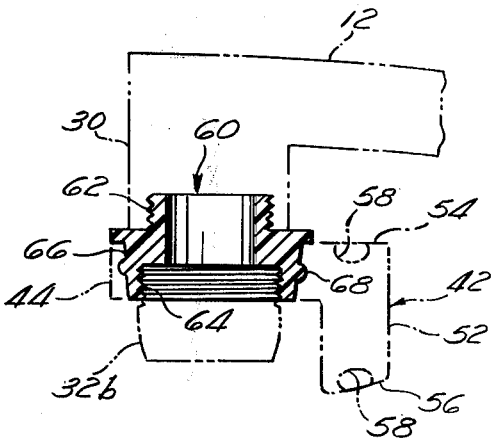
Fig. 5

SINK RINSING DEVICE

BACKGROUND OF THE INVENTION

This invention relates to devices for cleaning sinks and similar wash basins. In particular, the invention relates to a device which redirects and intesifies the stream of water emerging from the faucet so as to direct a forceful stream against the sides of the sink to aid in the cleaning and rinsing of the sink basin.

It has long been known that the chore of cleaning sinks can be facilitated somewhat by providing some means for directing a forceful stream of water from the faucet against the walls of the sink basin. Typically, such means have taken the form of a nozzle of one sort or another attached to the faucet by means of a flexible hose. While such devices have achieved the desired result of directing a forceful stream of water from the faucet to the sides of the sink, they are also a source of inconvenience due to the need to remove such devices when it is desired to use the sink in its normal manner, and to re-attach the devices when it is desired to rinse the sink again.

SUMMARY OF THE INVENTION

In its broadest sense, the present invention is an attachment for a sink faucet which allows the water flowing therefrom to be selectively diverted into a forceful stream directed against the sides of the sink. More specifically, the present invention comprises an accelerating nozzle attached by a flexible stem to a fitting which in turn is attached to the faucet spout or outlet above the aerator thereof. The fitting includes a rotatable element so that the nozzle can be rotated in 360 degree arc about the faucet spout. When normal operation of the faucet is desired, the flexible stem is placed in an unfolded position under the faucet so that the nozzle is out of the way of the stream flowing from the aerator. When it is desired to use the device to rinse the sink basin, the flexible stem is bent to bring the nozzle under the aerator. A protruding, knoblike button on the stem proximate the nozzle can be snapped into a mating recess or socket in the rotatable element to hold the nozzle underneath the faucent aerator.

The nozzle, which is preferably spoonlike in configuration, has an inlet portion near the juncture with the stem, and it is this inlet portion which directly underlies the aerator so that the water flowing from the faucet enters the nozzle at this inlet portion. The water then flows through a converging nozzle outlet which accelerates this stream and redirects it toward the walls of the sink basin. The acceleration and redirection of the water stream occur without any significant effect on the aeration induced by the faucet aerator so that excessive splashing is avoided.

When the flexible, resilient stem is bent in the aforementioned manner, it conveninetly forms a handle which may be easily gripped to facilitate the rotation of the nozzle so that all surfaces of the sink basin may be rinsed.

Thus, the present invention provides an easily installed sink rinsing device which can be used to direct a forceful stream of water toward each of the inner surfaces of the sink basin. Furthermore, the present invention has the significant advantage over prior art sink rinsing devices in that the present invention can remain attached to the faucet, even when it is not in use, thus avoiding the need for constant detachment and reattachment as with the aforementioned prior art devices.

BRIEF DESCRIPTION OF THE DRAWINGS

FIG. 1 is a perspective view of the present invention showing it attached to, and in use with, a typical sink;

FIG. 2 is a detailed perspective view of the present invention showing its attachment to the faucet shown in FIG. 1;

FIG. 3 is a perspective view of the nozzle and stem structure of the present invention;

FIG. 4 is a cross-sectional view along line 4—4 of FIG. 2; and

FIG. 5 is a cross-sectional view similar to FIG. 4, but showing an alternative embodiment of the faucet fitting used with the present invention.

DETAILED DESCRIPTION OF THE INVENTION

Referring first to FIGS. 1 and 2 of the drawings, a sink rinsing device 10 constructed in accordance with the present invention is shown attached to a faucet 12 of a sink 14. As shown most clearly in FIGS. 2 and 3, central to the invention is a generally spoon-shaped or disked shaped nozzle lower portion 16 having an integral handle or stem 18. The integral nozzle/stem structure 16, 18 is preferably made of a flexible resilient plastic material such as polypropylene.

Formed integrally with the spoon-shaped nozzle lower portion 16 is a nozzle upper portion in the form of an apron or shield 20 which encloses a part of the nozzle portion 16, thereby providing a nozzle inlet 22 and an outlet 24. The shield 20 is preferably so shaped that the outlet 24 is slightly constricted with respect to the inlet 22 so that the water flowing through the nozzle portion 16 is slightly accelerated to provide a more forceful stream.

Extending upwardly from the flexible stem 18 are a pair of projections 26, one of said projections 26 being formed at the end of the stem 18 proximate the juncture with the nozzle portion 16, and the other of said pair of projections 26 being provided at the opposite end of the stem 18. Each of the projections 26 terminates in a knob-like protuberance or button 28. The preferred shape of the knoblike buttons or protuberances 28 is somewhat elongate or elliptical in cross section, as opposed to spherical, for purposes which will be made clear hereinafter.

As shown in the drawings, the faucet 12, which is a typical faucet, terminates in a vertical outlet section 30. The lower end of the outlet section 30 may be either externally threaded to accommodate an internally threaded aerator **32*a*, as shown in FIG. 4, or internally threaded to accommodate an externally threaded aerator 32*b*, as shown in FIG. 5**.

Referring next to FIGS. 2 and 4, where the outlet section 30 of the faucet 12 is externally threaded to accommodate an internally threaded aerator **32*a*, the invention includes a tubular fitting 34, having an internally threaded inlet end 36 for attachment to the outlet section 39 of the faucet and an externally threaded outlet end 38 for attachment with the internally threaded aerator 32*a*. Thus, the fitting 34 may be installed simply by removing the aerator 32*a*, screwing the fitting 34 onto the outlet section 30 of the faucet, and then screwing the aerator 32*a* onto the outlet end 38 of the fitting 34**.

The fitting 34 has a middle or central portion 40 between the inlet end 36 and the outlet end 38. This central portion 40 is downwardly tapered so that it resembles an inverted, truncated right frusticone.

A rotatable member 42 has a generally annular portion 44 with an interior surface 46 shaped to conform to the exterior surface of the central portion 40 of the fitting 34. The interior surface 46 of the annular portion 44 of the rotatable member 42 has a circumferencial track or groove 48 which accommodates a circumferencial ridge 50 around the exterior of the central portion 40 of the fitting 34.

With the configuration shown, the rotatable member 42 may be snapped onto the central portion 40 of the fitting 34 and retained in place by the mating of the groove 48 and the ridge 50. With the fitting 34 and the rotatable member 42 so joined, the rotatable member 42 may be completely rotated around the fitting 34.

The rotatable member 42 has a laterally extending projection 52 which extends outwardly and downwardly from the annular portion 44. As best shown in FIg. 5, the projection 52 has an upper surface 54 and a lower surface 56, each having an elongate, elliptical socket 58 conforming to the shape of the knob-like protuberances or buttons 28 on the stem 18. The socket 58 on the upper surface 54 accommodates the knob or button 28 located at the end of the stem 18 farthest from the nozzle portion 16. The other socket 58 in the lower surface 56 accommodates the button 28 located near the juncture of the stem 18 and the nozzle portion 16, when the stem 18 is bent in the manner shown in FIGS. 2 and 4. The shape of the buttons 28 and the sockets 58 allows for a convenient snap fastening, while the elongate, elliptical configuration of these elements substantially prevents rotation of the knobs 28 in the sockets 58 so that when the stem 18 is in the configuration shown in FIGS. 2 and 4, the bent portion thereof may be grasped to rotate the moveable member 42 around the fitting 34.

FIG. 5 shows a modified fitting 60 which may be used when the outlet portion 30 of the faucet 12 is internally threaded to accommodate the externally threaded aerator **32*b*. The modified fitting 60 thus has an externally threaded inlet portion 62 and an internally threaded outlet portion 64 to accommodate the internally threaded faucet and the externally threaded aerator. As with the previously described configuration of the fitting, the modified fitting 60 has a central portion 66 in the form of an inverted, truncated right frusticone. The modified fitting 60 is made to be used with the same rotatable member 42 as previously described, and thus as a peripheral ridge 68 around the central portion 66 to accommodate the groove or track 48 in the rotatable member 42**.

It will be recognized that instead of using two different fittings 34 and 60 to accommodate different faucets and aerators, the invention can be made with either one of the above-described fittings, along with conventional adaptors to accommodate different faucet and aerator threads, as is well known in the art.

The operation of the invention is shown in FIGS. 1, 2 and 4. As shown in the broken outline in FIG. 2, when the device is not in use, the stem 18 and the nozzle portion 16 lie relatively flat proximate the underside of the faucet 12. In this position, water flows from the faucet outlet 30 through the interior of the fitting 34 (or the modified fitting 60) and finally out through the aerator **32*a* or 32*b* in a normal manner. When it is decided to rinse the sink using the device of the present invention, the stem 18 is bent in the manner illustrated, and the button or knob-like protuberance 28 near the juncture between the stem 18 and the nozzle portion 16 is snapped into the lower of the sockets 58 in the rotating member 42. This brings the inlet 22 of the nozzle portion 16 underneath the aerator so that water flowing from the aerator enters the inlet 22 and leaves the nozzle through the outlet 24 with a slightly increased force due to the slight acceleration imparted by the constricted outlet opening. the relatively open structure of the nozzle 16 allows the water leaving the nozzle outlet 24 to retain a substantial portion of the aeration produced by the aerator so that excessive splashing is avoided when the water strikes the sides of the sink basin 14**.

When the flexible stem 18 is bent in the manner shown, the bent portion thereof forms an arcuate handle which may be conveniently grasped for rotating the rotatable member 42 completely around the fixed tubular fitting. In this manner, the rinsing stream of water emerging from the nozzle outlet 24 may be directed in any direction along a 360 degree arc around the faucet outlet. Thus, the device may be used to rinse all areas of the sink basin 14. As best shown in FIG. 4, the nozzle should direct the rinsing stream of water at an angle which is slightly downward from the horizontal, for optimum rinsing action.

When rinsing is completed, the stem 18 is unsnapped from the lower socket 58 in the rotatable member 42, and the resilience of the stem brings it back to the position shown in broken outline in FIG. 2. Thus, the rinsing device may remain attached to the faucet, even while not in use, so that there is no need for constant detachment and reattachment as in prior art rinsing devices.

Various materials may be used for constructing the present invention. As previously mentioned, the stem 18, along with the integral nozzle portion 16, may be made of a flexible resilient plastic such as polypropylene, while the fittings 34 and 60 and the rotatable member 42 are preferably made of a relatively hard plastic having a relatively low coefficient of friction, so that the rotatable member 42 may be rotated without significant difficulty.

What is claimed is:

1. A device for rinsing a sink with water from the faucet of said sink comprising:

nozzle means having an inlet for receiving a generally vertical column of water from the faucet outlet, a lower portion for deflecting said column of water and an outlet for directing the deflected water column into a generally horizontal stream;

an elongate, flexible stem having one end attached to said nozzle means proximate said inlet;

first means for selectively maintaining the inlet of said nozzle means in an underlying relationship with the outlet of said faucet and the outlet of the nozzle facing generally laterally towards the sidewalls of said sink whereby water from said faucet is deflected in a directable stream towards the sides of the sink when said flexible stem is bent in a manner which produces said underlying relationship; and second means for rotatably connecting said stem to said faucet so that said nozzle may be rotated about a generally vertical axis around the outlet of said faucet when said nozzle is maintained in said underlying relationship with said faucet outlet.

2. The device of claim 1, wherein said second means comprises:

a fixed tubular fitting engageable with said faucet proximate said faucet outlet to allow water to flow therethrough; and a movable member rotatably engaging the exterior of said tubular fitting.

3. The device of claim 2, wherein said first means comprises:

means for removably fastening said one end of said stem to said movable member.

4. The device of claim 1, wherein said nozzle has a configuration which accelerates the water flowing therethrough.

5. The device of claim 2, wherein said tubular fitting comprises:

an inlet end engageable and in fluid communication with the outlet of said faucet;

an outlet end engageable with an aerator; and a middle portion between said inlet end and said outlet end, said middle portion rotatably engaging said movable member.

6. The device of claim 5, wherein said middle portion has a truncated frustoconical shape with a peripheral ridge around the exterior thereof, and said movable member has an annular portion with an interior surface of corresponding shape and with a peripheral groove which mates with said ridge.

7. The device of claim 1, wherein said nozzle comprises:

a generally spoon-shaped lower portion; and an upper portion, integral with said lower portion, and enclosing a section of said nozzle to define said nozzle inlet and said nozzle outlet.

8. The device of claim 3, wherein said means for removably fastening comprises:

a socket in said movable member; and a knob-like protuberance on said stem proximate said one end thereof, said knob being snugly engageable with said socket.

9. The device of claim 1, wherein said stem lies substantially flat along the underside of said faucet when said stem is unbent.

10. A device for rinsing a sink with water from the faucet of said sink, comprising:

first means for selectively diverting said water in a vertical stream of water generally horizontally laterally of said faucet in a shaped directable stream toward the walls of said sink, wherein said first means comprises a nozzle having an inlet and an outlet and an elongated flexible stem having a first end attached to said nozzle and a second end said stem being bendable to bring said inlet of said nozzle underneath the outlet of said faucet, said first end of said stem being removably attachable to said outlet end of said faucet when said stem is so bent, said stem lying substantially flat against the underside of said faucet when said stem is not bent and;

second means for rotatably connecting said first means to said faucet to hold said first means so that said stream of water is directed only generally horizontally laterally and may be rotated about a generally vertical axis.

11. The device of claim 10, wherein said nozzle is so shaped as to accelerate said stream of water.

12. The device of claim 10 wherein said first end of said stem is removably attachable to said second means by a snap fastener.

13. The device of claim 12 wherein said snap fastener comprises:

a knob like protuberance on said stem near said first end thereof; and socket means in said second means for engaging said protuberance.

14. A device for rinsing a sink with water from the faucet of said sink, comprising:

a hollow, tubular fitting having an inlet end engageable with the outlet of said faucet and an outlet end engageable with an aerator, so that the water may flow from said faucet outlet through said aerator;

a movable member rotatably engaging the exterior of said fitting between said inlet end and said outlet end, said member having a laterally-extending projection, said projection having an upper surface and lower surfaces;

a nozzle having an inlet and a water accelerating outlet; and an elongate, flexible stem having a first end attached to said nozzle proximate said inlet thereof and a second end connected to said movable member at said upper surface of said projection, said stem being bendable to bring said inlet of said nozzle underneath said aerator, said first end of said stem being removably attachable to said member at said lower surface of said projection when said stem is so bent, so that said stem thereby forms a handle for rotating said movable member around said fitting, said stem lying substantially flat against the underside of said faucet when said stem is not bent, the rotatable engagement between said movable member and said tubular fitting permitting rotation of said stem and said nozzle about a generally vertical axis around said tubular fitting.

* * * * *